US005530967A

United States Patent [19]

Cielo

[11] Patent Number: 5,530,967

[45] Date of Patent: Jul. 2, 1996

[54] HOCKEY TRAINING GLOVES WITH ATTACHABLE AND REMOVABLE WEIGHTS

[76] Inventor: Robert Cielo, 190 Oak Ave., Island Heights, N.J. 08732

[21] Appl. No.: 305,444

[22] Filed: Sep. 13, 1994

[51] Int. Cl.[6] ..... A41D 3/10; A41D 13/10

[52] U.S. Cl. ..... 2/16; 2/160

[58] Field of Search ..... 2/16, 159, 160, 2/161.1, 162, 20; 273/57.2; 482/44, 105, 93

[56] References Cited

U.S. PATENT DOCUMENTS

| | | | |
|---|---|---|---|
| 4,034,979 | 7/1977 | Wester | 273/54 |
| 4,239,211 | 12/1980 | Wilkerson | 482/105 |
| 4,247,097 | 1/1981 | Schwartz | 272/119 |
| 4,330,120 | 5/1982 | Netti | 272/119 |
| 4,371,983 | 2/1983 | Piotti, Jr. | 2/160 |
| 4,384,714 | 5/1983 | Kimura | 482/105 |
| 4,396,190 | 8/1983 | Wilkerson | 272/119 |
| 4,677,698 | 7/1987 | Angas | 2/161.1 |
| 4,684,123 | 8/1987 | Fabry | 2/160 |
| 4,700,404 | 10/1987 | Lespérance | 2/161.1 |
| 4,911,433 | 3/1990 | Walker et al. | 482/105 |
| 4,923,418 | 5/1990 | Hoffman | 482/105 |
| 4,967,418 | 11/1990 | Marcotte | 2/16 |

FOREIGN PATENT DOCUMENTS

| | | | |
|---|---|---|---|
| 2051912 | 3/1993 | Canada | 482/105 |

*Primary Examiner*—Michael A. Neas
*Attorney, Agent, or Firm*—Jacobson, Price, Holman & Stern

[57] ABSTRACT

A hockey players gloves with attachable and removable weights in which the weights are insertable and removable from a pocket associated with the gloves. In certain embodiments, a portion of a blocking pad is positioned between the inserted weight and the surface of the pad adapted to engage or block a hockey puck that may be traveling at a relatively high rate of speed. In other embodiments, the weight is insertable and removable from a pocket formed in the cuff area of each glove. The gloves may be used both as a warm up aid for use just prior to a game or as a training aid during various practice periods. The pocket receiving the weight is provided with a closure and the weight is preferably metal and provided with a coating of resilient material, such as rubber or the like.

3 Claims, 2 Drawing Sheets

HOCKEY TRAINING GLOVES WITH ATTACHABLE AND REMOVABLE WEIGHTS

BACKGROUND OF THE INVENTION

1. Field of the Invention

The present invention generally relates to training gloves with attachable and removable weights for use as training aids for individuals engaged in activities requiring hand dexterity and quick hand movement. More specifically, the present invention relates to hockey players gloves in which weights are insertable and removable from a pocket associated with the gloves in a manner which will not interfere with normal use of the gloves. In certain embodiments, the weight is associated with a pad on or in the glove so that a portion of the pad is positioned between the inserted weight and the surface of the pad adapted to engage or block a hockey puck that may be traveling at a relatively high rate of speed. In other embodiments, the pocket and weight are associated with a cuff area of each glove generally along the inner or outer surface of the wrist area of the hockey player that is not normally engaged by a puck. The gloves may be used both as a warm up aid just prior to a game or as a training aid during various practice periods. Padding in or on the hockey players gloves between the weight and the surface which faces the shooter prevents any contact of the hockey puck with the weight. Thus, the surface of the puck blocking pad facing the shooter retains its normal characteristics so that control of movement of the puck and rebound characteristics of the puck will be the same as occurs with conventional gloves. The cuff area of gloves worn by forwards and defensemen as well as goaltenders has limited padding but is not normally used to block a puck. Thus, the weight in the cuff area can be located closer to the surface of the cuff area of the glove. The pocket receiving the weight is provided with a closure and the weight is preferably metal and provided with a coating of resilient material, such as rubber or the like. The weight in the cuff area is curved to generally conform with the surface of the wrist area of the player.

2. Description of the Prior Art

The concept of utilizing an attached weight as a training aid or exercising device is well known. Baseball players frequently use doughnut shaped weights on the bat for training and warm up purposes with the weight being removed prior to the batter entering the batter's box. Ankle and wrist attached weights are also well known for use as training aids and exercising devices when walking, jogging and the like. The prior art also includes gloves having weights incorporated therein for use when jogging or exercising and a removable weight for a baseball glove or bowler's glove for use as a training aid for baseball players or bowlers. The following U.S. patents disclose and relate to the above mentioned prior art.

U.S. Pat. No. 4,034,979

U.S. Pat. No. 4,247,097

U.S. Pat. No. 4,330,120

U.S. Pat. No. 4,371,983

U.S. Pat. No. 4,396,190

The prior art does not disclose the structure of the above invention in which attachable and removable weights are associated with the padding in gloves worn by hockey players. The prior art does not disclose the embodiments of this invention in which at least a portion of the padding is oriented between the weight and the surface of the padding which faces the direction from which the puck is approaching to prevent contact between the puck and weight and prevent modification of the rebound characteristics imparted to the puck by the blocking pad. The prior art does not disclose embodiments of the invention in which the pocket and weight are associated with the cuff area of each hockey players glove. The prior art does not disclose the particular structure of the weight and does not disclose the particular structure and orientation of the pocket which removably receives and retains the weight.

SUMMARY OF THE INVENTION

An object of the present invention is to provide hockey players gloves with removable weights in which the glove includes a pad or padding having an external surface adapted to block movement of a puck in a trajectory defined by an opposing player striking the puck with a conventional hockey stick in a conventional manner. Each glove includes a pocket for insertion of a weight for use as a training aid to increase hand agility, dexterity, quickness and stamina when engaged in an actual hockey game to enable hockey players to more effectively block or catch a hockey puck.

Another object of the invention is to provide gloves for hockey players in which each glove is provided with a pocket for receiving an insertable and removable weight with the pocket being arranged interiorally of a pad or padding used in the gloves whereby the weight is spaced from the pad surface adapted to be engaged by an approaching hockey puck to prevent contact of the puck with the weight and provide padding between the weight and the approaching hockey puck.

Still another object of the invention is to provide gloves for hockey players in which the pocket and weight are incorporated into the cuff area of each glove.

A further object of the invention is to provide gloves for hockey players in accordance with the preceding objects in which the pocket is provided with a closure to retain the weight in the pocket and the weight is provided with a coating of resilient material, such as rubber or the like, to further preclude damaging contact of the puck with the weight which is preferably constructed of rigid metal or the like and of selected weight thereby precluding any damage to the hockey puck and eliminating modification of rebound characteristics imparted to the hockey puck thereby eliminating loss of control of rebound characteristics of the hockey puck.

Yet another object of the invention is to provide hockey players gloves with attachable and removable weights which can be incorporated into existing hockey player gloves for use as a warm up and training aid and is adapted for use by goaltenders in either or both the catching glove or stick glove to enable a goaltender to become more proficient in catching and blocking shots on goal and also adapted for use by forwards and defensemen to enable more efficient stick handling and shooting.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
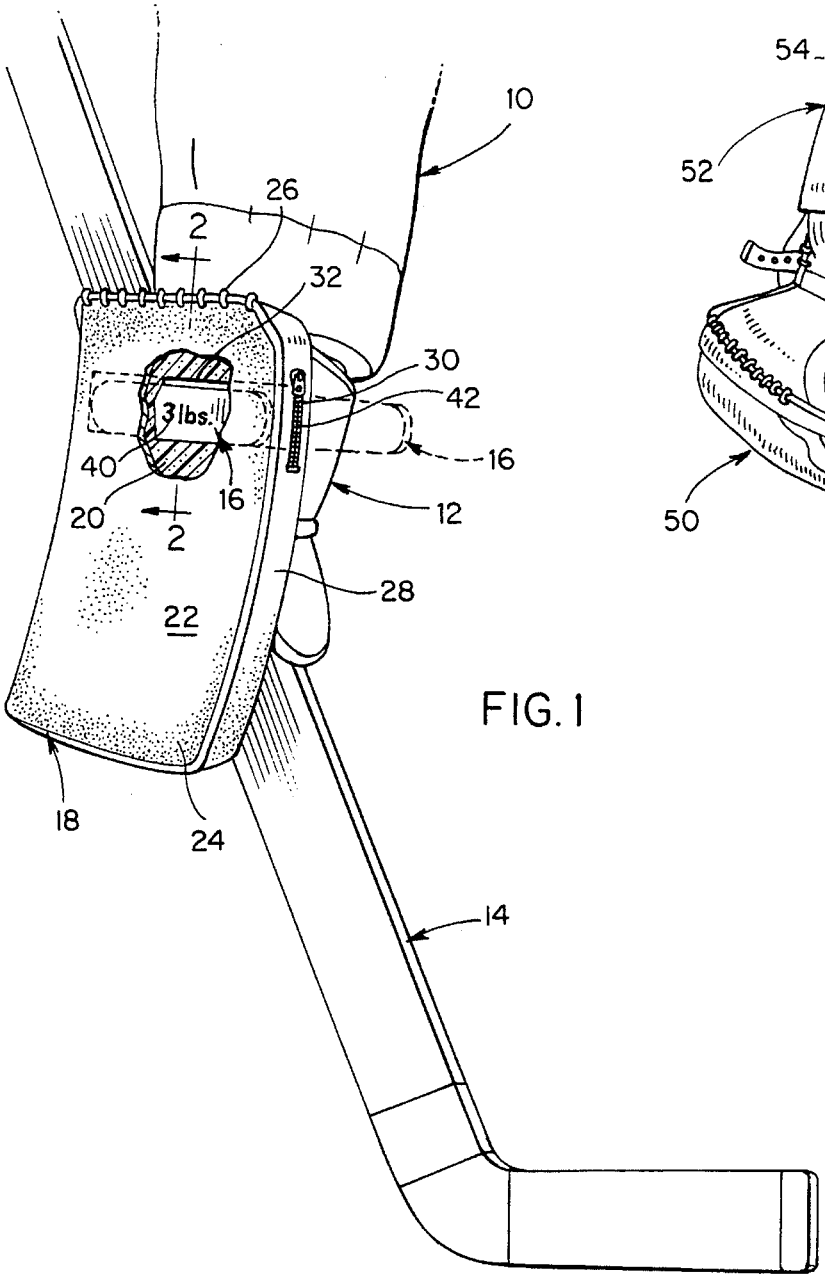
FIG. 1 is a perspective view of a goaltenders hockey stick glove with portions broken away illustrating the blocking pad, the pocket for an insertable weight and the association of the weight with the pad.
Figure 2:
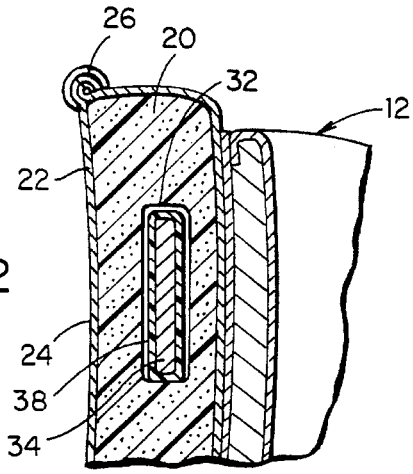
FIG. 2 is a sectional view taken along section line 2—2 on FIG. 1 illustrating the positioning of the pocket and the weight in spaced relation to the surfaces of the pad on the stick glove.
Figure 3:
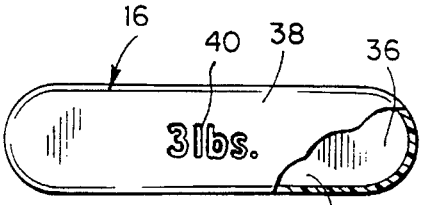
FIG. 3 is a plan view of the weight with portions broken away illustrating the rubber coating thereon.

Referring specifically to the embodiment of the invention illustrated in FIGS. 1–3, a hockey players arm is generally designated by reference numeral 10 with the arm depicted being a goaltenders arm having a glove 12 mounted on the hand of the goaltender in a conventional manner with the glove 12 being the stick glove by which the goaltender grasps and manipulates a conventional goaltenders hockey stick 14. The goaltenders stick glove 12 is of conventional construction with the exception of modifications being made to accommodate a removable weight generally designated by numeral 16.

The glove 12 includes a blocking pad 18 mounted on the glove in opposite relation to the palm of the glove in which the hockey stick 14 is grasped to serve as a blocking pad for blocking movement of a hockey puck in its trajectory toward a hockey goal in a manner well known in this art. The blocking pad 18 includes a pad 20 of cushioning or resilient material of rubber, foam rubber, foam plastic or the like which has a cover 22 forming a skin for the pad or padding 20. As illustrated, the pad 18 is generally rectangular in configuration and the blocking surface 24 which faces the shooter of the puck is slightly concavely curved in a conventional manner which enables some control of the rebound path of a puck that is blocked by the blocking pad 18. The cover 22 may be secured in place by lacing 26 or any other suitable stitching, bonding or the like with the aforementioned structure of the glove and pad being completely conventional.

One side edge 28 of the pad 18 is provided with an access opening 30 to a shallow pocket 32 formed in the pad or padding 20 with the pocket 32 extending transversely over a major portion of the width of the pad or padding 20 with the pocket 32 being spaced downwardly from the top edge of the pad or padding a relatively short distance. Also, the front and rear surfaces of the pocket 32 are spaced from the front and rear surfaces of the pad 20 as illustrated in FIG. 2.

The shape and size of the pocket 32 is generally similar to the dimensional characteristics of the weight 16 which includes an elongated rigid weight member of metal or similar heavy material that has a rectangular transverse cross-sectional configuration with the rigid member being designated by reference numeral 34 and being provided with rounded ends 36 and dimensioned to be inserted through and removed from the pocket 32 through access opening 30. The rigid weight member 34 is provided with a coating of rubber, plastic or the like 38 and provided with indicia 40 to indicate the weight characteristics of the insertable weight 16. It is pointed out that various weight characteristics of weight members can be utilized, such as 1 lb., 2 lb. and 3 lb. weights for progressive use during training or for selective use during training depending upon the desires and requirements of the individual players.

A closure structure is provided for the access opening 30 which, as illustrated in FIG. 1 is a slide type closure such as a zipper 42. Other types of fasteners may be used including "VELCRO" snaps buttons and the like in order to retain but enable insertion and removal of the weight 16.

Figure 4:
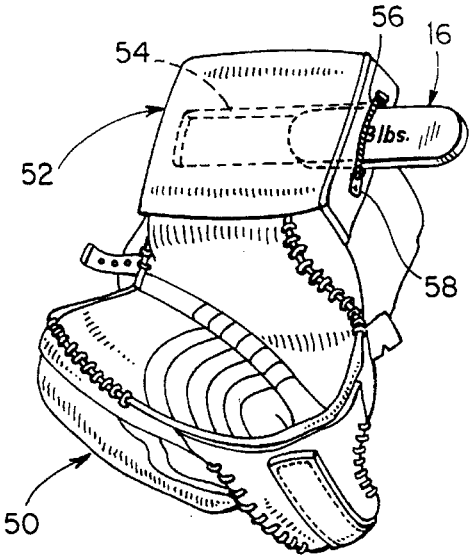
FIG. 4 is a perspective view of a hockey goaltenders catching glove illustrating the association of the weight in relation to the pad.

FIG. 4 illustrates an embodiment of the present invention in association with a goaltenders catching glove 50 which is also conventional and provided with the usual pad 52. In this embodiment of the invention, the pad 52 is provided with a pocket 54 receiving a weight 16 through an entrance opening 56 provided with a closure such as a slide type closure 58. The association of the weight 16, pocket 54 and pad 52 in this embodiment of the invention is the same as disclosed in detail in FIGS. 1 and 2 with the blocking glove 12. The same structure of the pad, pocket, insertable weight and closure can also be incorporated into the gloves worn by other hockey players for use as a training aid with the pocket for the weight always being spaced from the surface of the pad facing the hockey puck shooter with the pad or padding between the weight and the puck engaging surface of the pad to enable the pad to function in its usual manner with the weight enabling the player using the weighted glove or gloves to develop greater hand speed, enhance agility and dexterity and increase strength and stamina.

Figure 5:
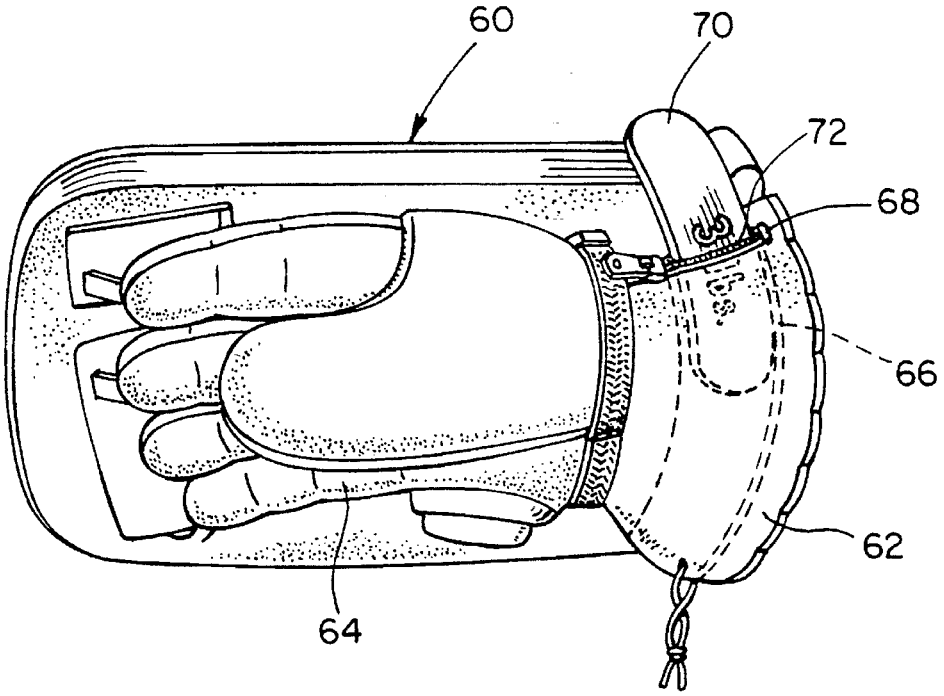
FIG. 5 is a perspective view of a goaltenders hockey stick glove from the inside illustrating the weight inserted into a pocket in the cuff area of the glove along the inside surface of the wrist area.

FIG. 5 illustrates a perspective view of a goaltenders stick glove 60 which is of conventional construction except that the weight is not inserted into a pocket in the blocking pad as illustrated in FIG. 1. In the stick glove 60, the glove includes a cuff area 62 which encloses and protects the wrist area of the goaltender and is provided with light padding since the wrist area is not normally engaged by a puck shot by an opponent. The structure of the hand receiving portion 64 of the glove is conventional and the cuff area 62 is provided with a pocket 66 extending from an opening 68 in an upper longitudinal portion of the cuff area for insertion and removal of a weight 70 constructed in the same manner as in FIG. 3 except that the weight 70 is arcuately curved to conform generally with the curvature of the cuff area and the inner surface of a wrist area of a hockey player. The pocket entrance opening 68 is provided with a closure 72 in the form of a slide closure or the like. Positioning the pocket opening at the upper portion of the cuff area 62 provides easier access to the pocket to facilitate insertion and removal of the weight 70. This embodiment of the invention functions in a manner similar to that in FIG. 1 except that the weight is associated with the lightly padded cuff area rather than the pad and functions in a similar manner for warm up and training purposes.

Figure 6:
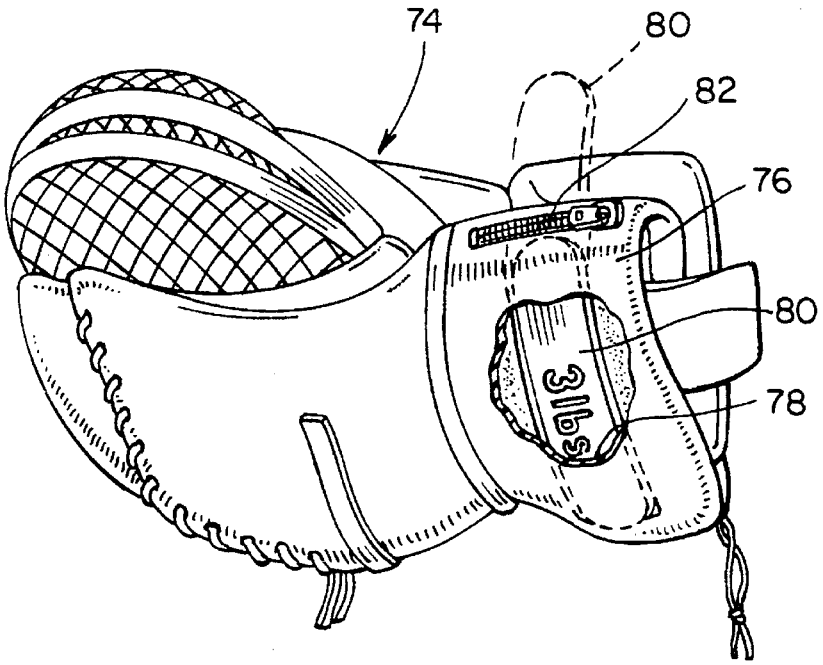
FIG. 6 is a perspective view of a goaltenders catching glove illustrating the weight and pocket in the cuff area along the outside surface of the wrist area.

FIG. 6 illustrates another embodiment of a hockey goaltenders catching 74 which is conventional in construction except for the cuff area 76 which is provided with a pocket 78 receiving a curved weight 80 insertable through an opening 82 provided with a closure for retaining the weight in the pocket. As in the other embodiments of the invention, the pocket opening is provided at the upper end of the outer portion of the cuff area and the closure may be a slide closure to facilitate insertion and removal of the weight which is oriented in the outer side of the cuff area 76 rather than in or on any of the more heavily padded areas of the glove 74.

The concepts of the present invention are disclosed as being incorporated into pre-existing hockey gloves to provide use as both a warm up and training aid. The insertable and removable weight may be incorporated into newly constructed hockey player gloves and in other glove structures where padding is used with the weight being positioned with padding between the weight and a surface to be engaged by a puck or projectile. The goaltenders gloves can alternatively be provided with a pocket and weight in the cuff area of each glove. Each of the hockey players gloves are provided with a one to three pound weight depending upon the size of the glove and the individual using the invention. As illustrated, padding remains on both sides of the weight when associated with a pad and adjacent the surface of the glove when associated with the cuff area of a glove. The weight is provided with a wrapping or coating of rubber or similar material to avoid chipping, cracking and the like. Inasmuch as the pocket or stitched compartment which holds the weight is closed by a zipper or "VELCRO" located on the outside edges of the glove, the weight itself can be removed after warm ups preceding a game and then reinserted before practice. This structure provides substantial advantages compared to weights that may be attached to the outside of gloves with straps or buckles with the built in construction making it impossible for contact of the weight with the puck which could result in loss of puck control or strange rebounds.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a hockey players glove having a pad provided with an outer surface facing a hockey puck shooter, an inner surface spaced from said outer surface, a peripheral side edge interconnecting said outer and inner surfaces, an elongated rigid training weight, said pad filling the space between the outer and inner surfaces, said pad including a transversely extending pocket spaced inwardly from the outer surface and outwardly from the inner surface, said spacing of the weight from the outer surface maintaining rebound characteristics of a hockey puck engaging said pad, said peripheral side edge having a longitudinal opening aligned with the pocket whereby the pocket in the pad is accessible from a portion of a periphery of said pad spaced from said surfaces for removably receiving said weight, said opening including a closure removably retaining said weight in the pocket, said pocket and weight extending substantially the entire distance between opposed side edges of the pad, said weight increasing resistance to movement of the glove during normal glove movements when practicing or warming up for playing hockey to enable a hockey player to increase hand and glove speed, increase agility of a hand having a glove mounted thereon and strengthen and increase stamina of the muscles controlling movement of a hand on which the glove is mounted.

2. The combination as defined in claim 1 wherein said glove is a hockey goaltenders stick grasping glove, said pad being generally rectangular with the pocket and weight being adjacent the end of the pad nearest a wrist area of the hockey goaltender.

3. The combination as defined in claim 1 wherein said glove is a hockey goaltenders puck catching glove, said pad being generally rectangular with the pocket and weight being substantially equally spaced from the ends of the pad.

* * * * *